United States Patent [19]

Takahashi et al.

[11] 4,401,138

[45] Aug. 30, 1983

[54] WOVEN SLIDE FASTENER STRINGER

[75] Inventors: Kihei Takahashi, Uozu; Kiyoshi Takeshima, Namerikawa, both of Japan

[73] Assignee: Yoshida Kogyo K. K., Tokyo, Japan

[21] Appl. No.: 288,489

[22] Filed: Jul. 30, 1981

[30] Foreign Application Priority Data

Aug. 8, 1980 [JP] Japan ..... 55-112488

[51] Int. Cl.[3] ..... A44B 19/34; A44B 19/04

[52] U.S. Cl. ..... 139/384 B; 24/205.13 R; 24/205.16 R

[58] Field of Search ..... 139/384 B; 24/205.13 R, 24/205.13 C, 205.16 R, 205.16 C, 205.13 D, 205.1 C

[56] References Cited

U.S. PATENT DOCUMENTS

| | | | |
|---|---|---|---|
| 3,302,259 | 2/1967 | Waldes | 24/205.16 R X |
| 3,487,531 | 1/1970 | Cuckson et al. | 24/205.13 R X |
| 4,033,014 | 0/1977 | Manning | 24/205.16 R |
| 4,058,145 | 11/1977 | Frohlich et al. | 139/384 B |
| 4,291,440 | 9/1981 | Yoshida | 24/205.16 R |
| 4,297,770 | 11/1981 | Wulz | 24/205.16 R |

FOREIGN PATENT DOCUMENTS

| | | | |
|---|---|---|---|
| 2061181 | 5/1981 | United Kingdom | 24/205.13 R |

*Primary Examiner*—James Kee Chi

*Attorney, Agent, or Firm*—Hill, Van Santen, Steadman & Simpson

[57] ABSTRACT

A woven slide fastener stringer comprising a woven stringer tape and a coupling element assembly woven into the tape along its one longitudinal edge. The assembly includes a row of coupling elements spaced along and molded around a connector. Each coupling element has a pair of grooves extending transversely through a pair of first and second leg portions, respectively, on their respective outer sides. A pair of anchor threads extend through the grooves of the first leg portions and through the grooves of the second leg portions, respectively, along the full length of the coupling element row. A weft thread of the tape has a plurality of loops each encircling the connector and the anchor threads between adjacent coupling elements. Each loop of the weft thread is open widely, perpendicularly of the general plane of the tape, urging the anchor threads toward one another between adjacent coupling elements to hold the individual coupling elements firmly in position.

5 Claims, 7 Drawing Figures

WOVEN SLIDE FASTENER STRINGER

BACKGROUND OF THE INVENTION

1. Field of the Invention:

The present invention relates to slide fasteners, and more particularly to a woven slide fastener stringer including a woven stringer tape and a coupling element assembly woven into the stringer tape along a longitudinal edge thereof. The coupling element assembly includes a row of coupling elements spaced at regular intervals along a connector and molded therearound.

2. Prior Art:

Various woven slide fastener stringers have been known in which a row of coupling elements spaced along and molded around a connector, in the form of at least one thread or elongate warp-knit web, is woven into a woven stringer tape along a longitudinal edge thereof simultaneously with the weaving of the tape. The stringer tape is woven of a plurality of warp threads and a weft thread. The coupling elements are secured to the tape by a plurality of loops of the weft thread, each of the loops encircling solely the connector between an adjacent pair of the coupling elements. The common problem with the prior art stringers is that since each loop is open with only a very limited space perpendicularly of the general plane of the tape, a firm attachment of the coupling elements to the tape is difficult to achieve.

SUMMARY OF THE INVENTION

A row of spaced molded coupling elements connected by a connector is secured to a woven stringer tape along a longitudinal edge thereof by a weft thread of the tape. Each of the coupling elements has a pair of grooves extending through a pair of opposed first and second leg portions, respectively, on their respective outer sides, each groove being disposed adjacent to a heel of the respective leg portion. A pair of anchor threads extends through the grooves of the first leg portions and through the grooves of the second leg portions, respectively, along the full length of the row of coupling elements. The weft thread of the tape has a plurality of loops each encircling the connector and the two anchor threads between an adjacent pair of the coupling elements. Each loop of the weft thread is open widely, perpendicular of the general plane of the tape, with its maximum height at the anchor threads, urging the anchor threads toward one another between adjacent coupling elements to hold the individual coupling elements firmly in position.

Accordingly a primary object of the invention is to provide a woven slide fastener stringer in which a row of spaced molded coupling elements is attached to the tape with sufficient firmness.

Another object of the invention is to provide a woven slide fastener stringer which is free from staggering pitches of coupling elements.

Many other advantages, features and additional objects of the present invention will become manifest to those versed in the art upon making reference to the detailed description and the accompanying drawings in which preferred embodiments incorporating the principles of the present invention are shown by way of illustrative example.

DETAILED DESCRIPTION

Figure 6:
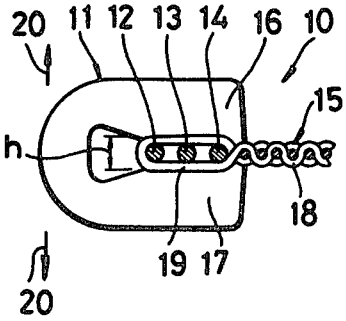
FIG. 6 PRIOR ART
FIGS. 6 and 7 are fragmentary schematic cross-sectional views of prior art woven slide fastener stringers of different types.

FIG. 6 illustrates a prior art woven slide fastener stringer 10 in which a row of spaced molded coupling elements 11 (only one shown) interconnected by three parallel connecting threads 12,13,14 is woven into a woven stringer tape 15 along a longitudinal edge thereof. The connecting threads 12,13,14 extend transversely of the coupling elements 11 and are embedded in leg portions 16,17 of each coupling element. A weft thread 18 of the woven stringer tape 15 has a plurality of loops 19 (only one shown) each encircling the connecting threads 12,13,14 between an adjacent pair of the coupling element 11. Since the connecting threads 12,13,14 are arranged in a row, each loop 19 of the weft thread 18 is open with only a very limited space vertically; that is, the loop 19 has a very limited height h. With this arrangement a firm attachment of the coupling elements 11 to the tape 15 is difficult to achieve, and hence the coupling elements 11 tend to be "rolled" or angularly moved with respect to the tape 15 in the directions indicated by arrows 20.

Figure 7:
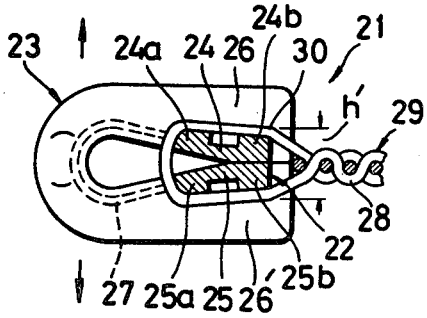
FIG. 7 PRIOR ART

FIG. 7 illustrates another type of prior art woven slide fastener stringer 21. In the fastener stringer 21 a warp-knit elongate, ladder-like structure 22 is used to interconnect a row of spaced molded coupling elements 23. The warp-knit elongate structure 22 includes a pair of elongate warp-knit webs 24,25 extending transversely of the coupling elements 23 and embedded in opposed leg portions 26,26', respectively, of each coupling element. Each of the warp-knit webs 24,25 has a pair of wales **24*a*,24*b* and 25*a*,25*b*, respectively, of chain stitches. The warp-knit elongate structure 22 further includes at least one connecting thread 27 interlaced or interknitted with the warp-knit webs 24,25. The connecting thread 27 has transverse portions extending between the warp-knit webs 24,25 and embedded longitudinally in the coupling elements 23, as indicated by phantom lines. A weft thread 28 of a woven stringer tape 29 has a plurality of loops 30 each encircling the two warp-knit webs 24,25 and thus the four wales 24*a*,24*b*,25*a*,25*b* between an adjacent pair of the coupling elements 23. Since the two warp-knit webs 24,25 lie over and under one another, each loop 30 of the weft thread 28 is open with a relatively wide space vertically and thus has an increased height h', compared with the loop 19 in FIG. 6. However, this height h' is stil insufficient to secure the coupling elements 27 to the tape 29** properly and firmly.

Figure 1:
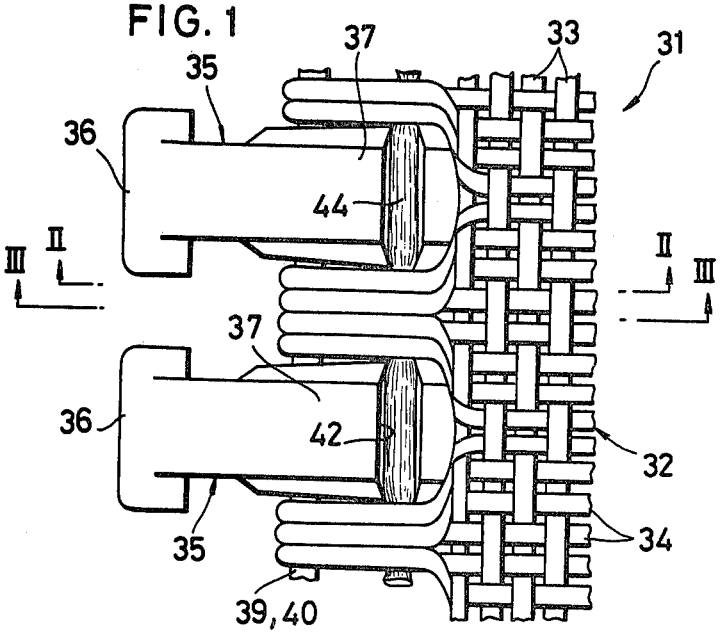
FIG. 1 is a fragmentary schematic plan view of a woven slide fastener stringer embodying the present invention.
Figure 2:
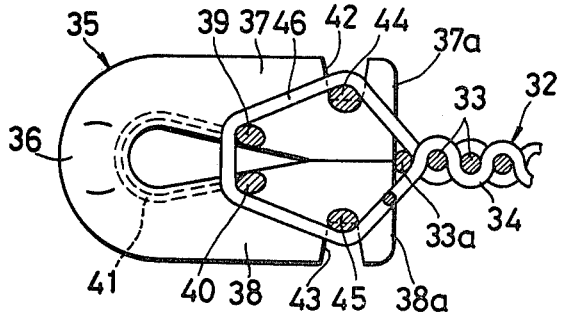
FIG. 2 is a cross-sectional view taken along line II—II of FIG. 1.

The present invention is an improvement over the prior art described above, and the principles of the invention are particularly useful when embodied in a woven slide fastener stringer such as shown in FIGS. 1 and 2, generally indicated by the numeral 31.

The slide fastener stringer 31 comprises a stringer tape 32 woven of a plurality of warp threads 33 and a single weft thread 34, and a coupling element assembly (described below) woven into the tape 32 along one longitudinal edge thereof in a known manner.

Figure 4:
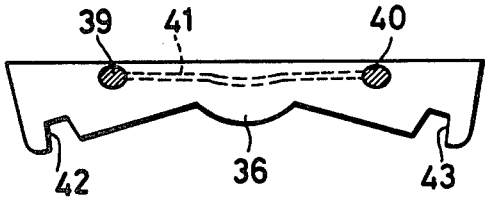
FIG. 4 is a schematic front view of a molded coupling element blank as it is spread flat before being bent into a U shape.

The coupling element assembly includes a row of spaced molded coupling elements 35 made of a thermoplastic synthetic resin, and an elongate ladder-like connector (described below) extending along the coupling-element-supporting tape edge and interconnecting the coupling elements 35. Each of the coupling elements 35 has a head portion 36 and a pair of upper and lower (first and second) leg portions 37,38 extending in substantially the same direction from the head portion 36. FIG. 4 illustrates a molded coupling element blank lying flat before being bent into a U shape to provide a single coupling element 35.

Figure 3:
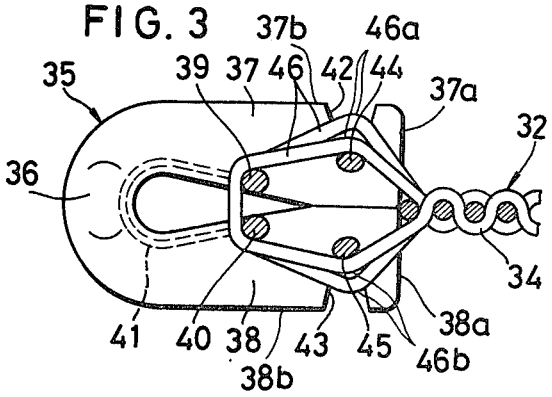
FIG. 3 is a cross-sectional view taken along line III—III of FIG. 1.

The ladder-like connector includes a pair of longitudinal members 39,40 extending transversely of the coupling elements 35 and embedded in the upper and lower leg portions 37,38 respectively, of each coupling element on their respective inner sides. The connector further includes a plurality of transverse members 41 (only one shown) spaced longitudinally along and extending transversely between the longitudinal members 39,40. Each transverse member 41 is embedded longitudinally in one of the coupling elements 35, as indicated by phantom lines in FIGS. 2, 3 and 4.

Each coupling element 35 has a pair of grooves 42,43 extending transversely through the upper and lower leg portions 37,38, respectively, on their respective outer sides. Each groove 42,43 is disposed adjacent to a heel 37*a*,38*a* of the respective leg portion 37,38. A pair of anchor threads 44,45 extends through the grooves 42 of the upper leg portions 37 and through the grooves 43 of the lower leg portions 38, respectively, along the full length of the row of coupling elements 35.

The weft thread 34 of the woven stringer tape 32 has a plurality of loops 46 along the coupling-element-supporting tape edge, each loop 46 encircling the longitudinal members 39,40 of the connector and the anchor threads 44,45 between an adjacent pair of the coupling elements 35. The two longitudinal connector members 39,40 and the two anchor threads 44,45 are arranged one at each corner of a polygon, such as a trapezoid, the distance between the anchor threads 44,45 being appreciably greater than the distance between the longitudinal connector members 39,40. That is, each loop 46 of the weft thread 34 is widened vertically, i.e. perpendicularly to the general plane of the tape 32, with its height increasing gradually from the longitudinal-connector-member corners (39,40) to the anchor-thread corners (44,45). The height of each loop 46 then decreases gradually from the anchor-thread corners (44,45) to the outermost warp thread 33*a* (FIG. 2) of the tape 32. Thus the individual loops 46 have a pentagonal figure.

Each groove 42,43 has such a depth that the outermost (uppermost and lowermost) surfaces 46*a*,46*b* (FIG. 3) of the individual loop 46 is disposed inwardly of the outer surfaces 37*b*,38*b* of the upper and lower leg portions 37,38, respectively, thus preventing the loops 46 and the anchor threads 44,45 from being engaged or caught by a slider (not shown) during opening and closing operation of a slide fastener.

With the trapezoidal arrangement of the anchor threads 44,45 and the longitudinal connector members 39,40, the anchor threads 44,45 are urged toward one another between adjacent coupling elements 35 under the tension of the weft thread loops 46, thus holding the opposed leg portions 37,38 of the individual coupling elements 35 against one another with an increased degree of force. This arrangement produces in a sufficiently firm attachment of the coupling elements 35 to the tape 32. Further, this woven slide fastener stringer 31 is free from staggering pitches of the coupling elements 35.

Figure 5:
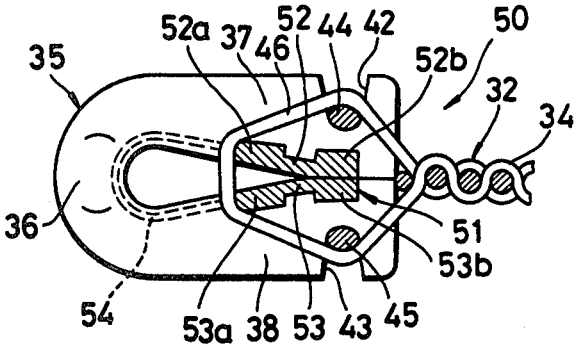
FIG. 5 is a view similar to FIG. 2, but showing a modified woven slide fastener stringer.

FIG. 5 illustrates a modified woven slide fastener stringer 50 having a modified coupling element assembly in which a warp-knit elongate, ladder-like connector 51 is used to interconnect the coupling elements 35.

The warp-knit elongate connector 51 includes a pair of longitudinal members in the form of an elongate warp-knit webs 52,53 extending transversely of the coupling elements 35 and embedded in the upper and lower leg portions 37,38, respectively, of each coupling element on their respective inner sides. Each of the warp-knit webs 52,53 has a pair of wales 52*a*,52*b* and 53*a*,53*b*, respectively, of chain stitches. The warp-knit elongate connector 51 further includes at least one transverse member in the form of a connecting thread 54 interlaced or interknitted with the warpknit webs 52,53. The connecting thread 54 has transverse portions extending between the warp-knit webs 52,53 and embedded longitudinally in the coupling elements 35, as indicated by broken lines.

In the fastener stringer 50, each loop 46 of the weft thread 34 encircles the anchor threads 44,45 and the wales 52*a*,53*a* of the warp-knit webs 52,53 between an adjacent pair of the coupling elements 35. The two wales 52*a*,53*a* and the two anchor threads 44,45 are arranged one at each corner of a trapezoid, the distance between the anchor threads 44,45 being appreciably greater than the distance between the wales 52*a*,53*a*.

Just like the embodiment shown in FIGS. 1 and 2, this trapezoidal arrangement of the anchor threads 44,45 and the wales 52*a*,53*a* results in a sufficiently firm attachment of the coupling elements 35 to the tape 32.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A woven slide fastener stringer comprising:

(a) a stringer tape woven of a plurality of warp threads and a weft thread;

(b) a coupling element assembly woven into said stringer tape along one longitudinal edge thereof, said coupling element assembly including a row of spaced molded coupling elements each having a head portion and a pair of first and second leg portions extending from said head portion, and a connector interconnecting said coupling elements, said connector having longitudinal portions extending transversely through and embedded in said leg portions of each said coupling element;

(c) each said coupling element having a pair of grooves extending transversely through said first and second leg portions, respectively, on their respective outer sides, each of said grooves being disposed adjacent to a heel of the respective leg portion; and (d) at least a pair of anchor threads extending through said grooves of said first leg portions and through said grooves of said second leg portions, respectively;

(e) said weft thread having a plurality of loops each encircling said connector and said anchor threads between an adjacent pair of said coupling elements, each said loop being widened perpendicularly to the general plane of said stringer tape.

2. A woven slide fastener stringer according to claim 1, said connector comprising a pair of longitudinal members extending transversely of said coupling elements and embedded in said first and second leg portions, respectively, of each said coupling element on their respective inner sides, and a plurality of parallel transverse members spaced longitudinally along and extending between said longitudinal members and embedded longitudinally in said coupling elements, each said loop of said weft thread encircling said longitudinal members and said anchor threads.

3. A woven slide fastener stringer according to claim 1, said connector comprising a pair of elongate warp-knit webs extending transversely of said coupling elements and embedded in said first and second leg portions, respectively, of each said coupling element on their respective inner sides, and at least one connecting thread interconnecting said warp-knit webs, said connecting thread having parallel transverse portions spaced longitudinally along and extending between said warp-knit webs and embedded longitudinally in said coupling elements, each said loop of said weft thread encircling said warp-knit webs and said anchor threads.

4. A woven slide fastener stringer according to claim 2, said longitudinal members and said anchor threads in cross-section being disposed one at each corner of a trapezoid, the distance between such two anchor-thread corners being appreciably greater than the distance between such two longitudinal-member corners.

5. A woven slide fastener stringer according to claim 3, each of said warp-knit webs having a pair of longitudinal wales, one of said wales of one of said warp-knit webs and one of said wales of the other warp-knit web and said anchor threads in cross-section being disposed one at each corner of a trapezoid, the distance between such two anchor-thread corners being appreciably greater than the distance between such two longitudinal-wale corners.

* * * * *